United States Patent [19]

Kimmel

[11] 4,183,679

[45] * Jan. 15, 1980

[54] MIXER, PARTICULARLY HEATING—COOLING MIXER FOR CHEMICAL PROCESSES

[75] Inventor: Hans Kimmel, Detmold, Fed. Rep. of Germany

[73] Assignee: Gunther Papenmeier KG Maschinen-und Apparatebau, Fed. Rep. of Germany

[ * ] Notice: The portion of the term of this patent subsequent to Jan. 26, 1996, has been disclaimed.

[21] Appl. No.: 580,285

[22] Filed: May 23, 1975

[30] Foreign Application Priority Data

Jun. 11, 1974 [DE] Fed. Rep. of Germany ..... 2428153

[51] Int. Cl.[2] ..... B01F 7/14

[52] U.S. Cl. ..... 366/288

[58] Field of Search ..... 259/102, 5, 21, 40, 259/64, DIG. 45; 366/288, 295, 312

[56] References Cited

U.S. PATENT DOCUMENTS

| | | | |
|---|---|---|---|
| 171,832 | 1/1876 | McIntyre | 259/102 |
| 506,636 | 10/1893 | Harvey | 259/DIG. 45 |
| 576,296 | 2/1897 | Ball | 259/102 |
| 875,234 | 12/1907 | Avram | 259/64 D |
| 2,237,957 | 4/1941 | Christensen et al. | 259/102 |
| 3,243,163 | 3/1966 | Brown | 259/102 |

*Primary Examiner*—John W. Shepperd

*Attorney, Agent, or Firm*—LeBlanc, Nolan, Shur & Nies

[57] ABSTRACT

A mixer is described having at least one mixing element which rotates relative to a mixing container axis. The mixing element comprises a plurality of vertical rods held by a revolving plate. The velocity and the direction of rotation of the mixing element about the container axis and the rotation of the element about its own axis are such that particles of mix material contacting the mixing element have at all points the same contact velocity.

7 Claims, 10 Drawing Figures

7
Vp
VMa
8a
ω
Vr
D
2
e
R
P
0

7
Vp
VMb
8b
ω
Vr
d
e
R
P
0

7
Vp
VMc
8c
ω
d
Vr
e
R
P
0

Fig. 6
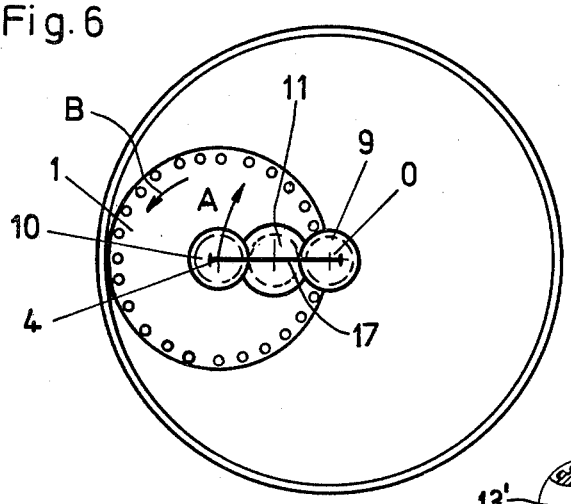
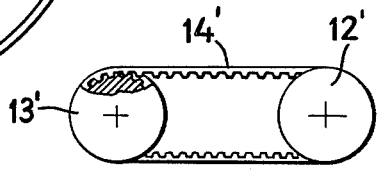
Fig. 10
Fig. 7
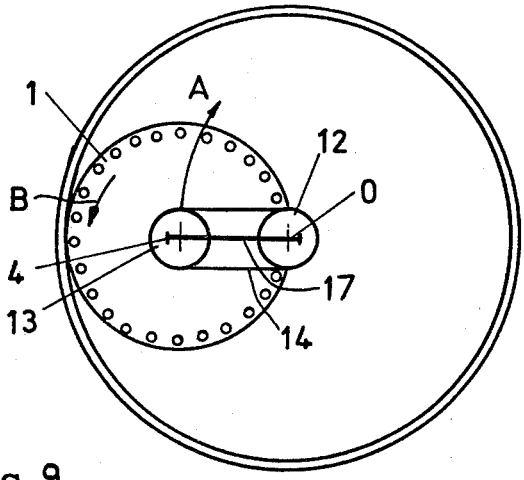
Fig. 9
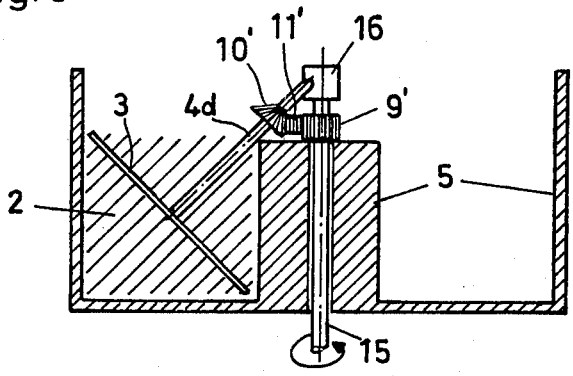

MIXER, PARTICULARLY HEATING—COOLING MIXER FOR CHEMICAL PROCESSES

This invention relates to a mixer particularly adapted for heating and cooling for use in chemical process applications. The mixer has a symmetric mixing element which comprises a plurality of mixing rods which are parallel to the mixing container axis and the rotation axis of the mixing element. The mixing element follows a planet-like movement about the container axis; the direction of rotation of the element is opposite to that of the rotation of the element about its own axis. Such a mixer is shown in DT-PS No. 344,764.

The prior art mixer shows a revolving mixing container having two cage-like mixing elements which are rotatably attached to two rigidly mounted arms. A gear rigidly mounted on the container, drives the mixing element via an intermediate gear located on the arm. The direction of movement of the element about its own axis is the same as the direction of movement of the container about the container axis.

Those skilled in the art were previously of the opinion that, in order to achieve particularly good mixing, the speed of revolution of the mixing element should be relatively high in comparison with the speed of revolution of the planet-like movement with which the element moves about the container axis. In the case where such a mixer is used as a heating mixer, where the warming effect is produced by means of friction in the mixing material itself and between the mixing material and the mixing element, the mixer will be limited in its effect by means of the warming of the outer extremity of the mixing element.

The center of the mixing element will remain relatively cool causing a non-uniform heat distribution in the mixing element and in the mix material. This is particularly unacceptable in the case where the warming is to bring about a chemical or physical transformation since this will cause the transformation to be non-unform.

According to the instant invention, a mixer is disclosed in which a constant mixing pattern is achieved over the total cross-section and over the total longitudinal section of the mix container; that is, on all positions where mixing material contacts the mixing elements, a constant velocity is obtained, thereby causing a uniform warming of the mix material and the mixing element.

In order to accomplish this, the angular velocity must satisfy the condition $\omega_P = \omega_M$ wherein $\omega_P$ is an angle of velocity of the mixing element about the mixing container axis and $\omega_M$ is the angle of velocity of the mixing element about its own axis. If one would watch the movement of the mixing element in the mixing container, it would appear that the mixing element did not revolve at all. Any particular point located on the mixing element describes a circular path about the container axis. This is the reason that the usual propeller or rake is not used as a mixing element, since this could not cover the total container cross-section. The mixing element advantageously comprises a plurality of rods which are preferably regularly distributed about the circumference of an element and are located about the rotational axis of the mixing element.

A mixing element turns about its own axis so often as it is turned about the container axis; no prior art device operates in this fashion. In the case of a revolving container, the container speed of revolution equals the speed of revolution of the mixing element. Up to now, it was not known that, by this means, all particles of mix material throughout the container will contact the rods of the mixing elements at the same speed. In the mixer shown in the afore-mentioned DT-PS No. 344,764, this is not the case, since this mixer has a mixing element which rotates at a much higher speed than the container.

If the mixing element is to be used to actively temper the mixing material, an appropriate apparatus can be provided, e.g. the rods of the mixing elements can contain electric windings or a heating or cooling medium can be circulated through the rods and be connected to an appropriate circulation system. Since the mixing element according to the invention rotates about its own axis only one time for every single planet-like circulation, the driving means for the elements can be of particularly simple construction. A simple driving connection between the driving axis of the mixing element and the axis of the container will suffice. The axis of the mixing element and the axis of the container can each carry a gear, the gears being connected by a free-running connecting gear and having the same amount of teeth; the connecting gear will be carried by the same means which connects the container axis to the mixing element axis. It is also possible to locate a toothed pulley on each axis, each pulley having the same diameter and being connected by a toothed belt. This belt causes a movement in which the axis of the mixing element does not turn relative to the axis of the container during the planet-like movement of the mixing element about the container axis.

With respect to this embodiment, the difference between the inventive concept and known mixer is particularly clear. As has already been mentioned, there is produced a uniform mix pattern over the total container cross-section. This is an important advantage over the prior art. Another important advantage is that, with the same container dimensions and the same contact velocity the kinetic energy which is released for warming is three-times higher with the mixer of the invention as in the prior art mixers.

Another advantage of this invention is that the mixing element contacts the mixing material equally with all of its surfaces; therefore, there will be no shadow-like build-up of mix material deposits on the mixing element. A disadvantage generally found in the prior art.

Although the main advantage of the invention is seen in the case where one wishes to achieve a uniform warming of the mixing material, the invention can also be utilized in the case where a uniform mix pattern is desired, e.g. in case of mixing volatile liquids where one seeks to disturb the upper surface as little as possible. For the mixing of this type of material, one can utilize a mixer with a mixing element which is inclined with respect to the container axis. The speed of revolution is adjusted so that $\omega_M = \omega_P \cos \alpha$ where $\alpha$ is the angle between the axis of the element and the container. One would not obtain a uniform mixing pattern in the direction of the container axis; however, one would achieve this in the direction perpendicular to the container axis. This type of mixer also has an improved mixing pattern with respect to the similar known mixers.

Referring to the Figures:

FIGS. 6 and 7 are schematic showings of embodiments of coupling between the container axis and the mixing element driving axis seen from above.

FIG. 9 is a schematic showing of a mixer having a mixing element axis inclined with respect to the container axis.

FIG. 10 is a diagrammatic representation of a toothed belt and pulley arrangement that may be used in the belt drive of FIGS. 7 and 8.

Figure 1:
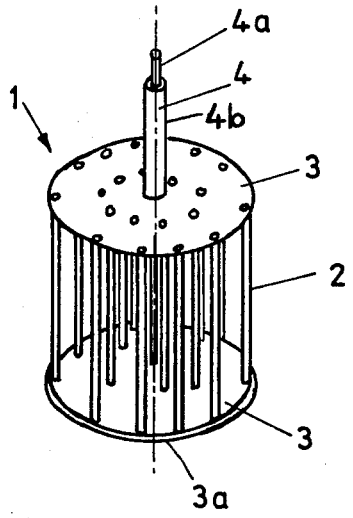
FIG. 1 shows a mixing element for use in the mixer according to the invention.

As mentioned, the mixing element according to the invention cannot be the usual blade, propeller, rake or similar object; it is necessary that the mixing element be relatively uniform about its circumference. Such a mixing element is shown in FIG. 1. This element consists of a plurality of rods 2 located about the axis of the mixing element in a circular uniform pattern. The rods 2 are preferably carried by a single circular plate 3. When the mixing element is removed from the container, the material can drop from the free end of the rods 2. If need be, a second plate 3 can be located at the underside of the rods 2 as is shown in FIG. 1. Such an arrangement has advantages in heat exchange circulation systems. The total system can be connected to a heating-cooling circulation system (not shown). For this purpose, the plates 3 are hollow and build, with the hollow rods a plurality of chambers. The axis 4 would be in this case, a double-walled connection to the lower chamber.

Figure 2:
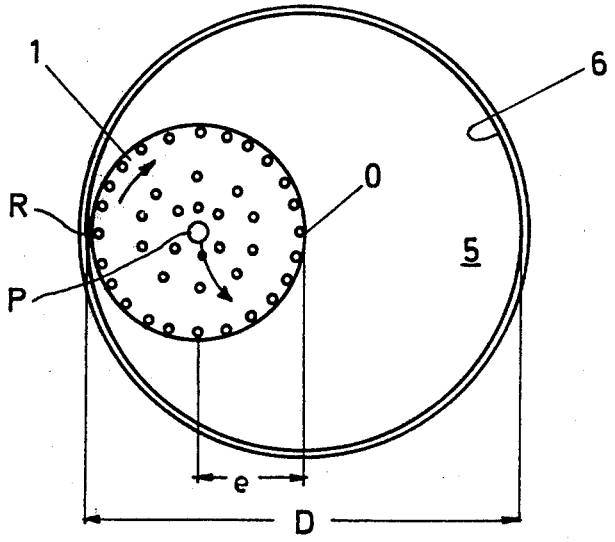
FIG. 2 shows schematically the container and mixer from above.

The Figure shows a piece 4*a* which extends out of shaft 4*b* and the double floor 3*a* on the lower end of the mixing element 1. The double wall construction is not shown in the upper plate. FIG. 2 shows schematically the arrangement of the mixing element 1 and the container 5. A single element 1 is shown in the drawing, however, it should be noted that a second element may be also included diametrically opposite that shown. The diameter of the element of this embodiment is approximately one half of the diameter of the container D. The eccentricity e of the axis P of the mixing element is approximately D/4. The mixing element 1 approaches the axis O of the mixing container S as well as the inner wall 6, this latter at point R.

Figure 3:
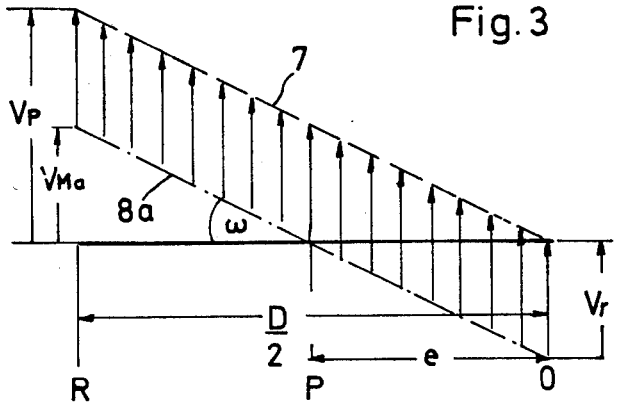
FIGS. 3 through 5 show mixing patterns for various embodiments of mixers having identical container diameters.

The directions of rotation of the planet-like movement of the axis P and the direction of rotation of the mixing element 1 about its axis are shown with the arrows of FIG. 2. FIG. 3 shows a mixing pattern which corresponds to the mixing element of FIG. 2. The broken line 7 is the upper limit of the mixing pattern which is achieved when the mixing element is rotated about the axis O of the container while holding its own axis rigid (or if one were to rotate the container 5 and hold the mixing element 1 stationary). The linear velocity is equal to O at middle point O and a maximum value $V_P$ at point R, i.e. near the container edge.

A second rotational movement has, as its center, point P which is a distance of D/4 from the container axis O. The angular velocity of this movement is as large as the angular velocity of the planet-like movement and reaches a maximum speed of $V_{Ma}$ which is substracted from the speed of the velocity caused by the planet-like movement. The rotary motion of the mixing element is shown with the broken line 8*a*. A differential which is constant over the total radius D/2 of the container is shown by means of the arrows between the lines 7 and 8*a*. The resulting speed $V_r$ is equal to the speed with which the axis of the mixing element revolves about the container axis O.

Figure 4:
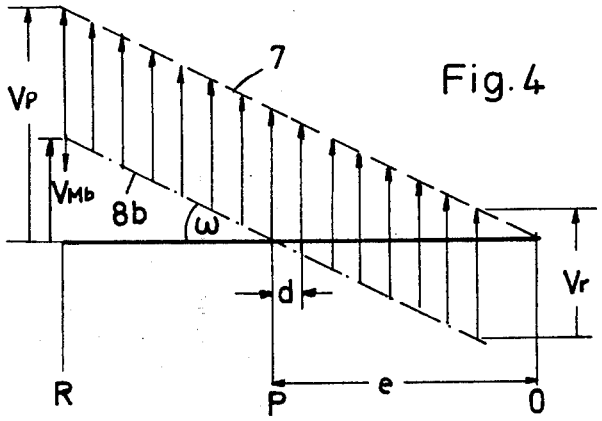

FIG. 4 shows an embodiment in which the diameter of the mixing element is smaller than that of the previous embodiment. This corresponds to the case where the diameter of the container axis is so large that it cannot be ignored; this will occur where the driving means of the mixing elements extend from underneath the container through the container's shaft. The eccentricity of the axis of the mixing element is therefore greater than in the previous examples and, with the same angular velocity, the maximum velocity $V_{Mb}$ on the outer end of the mixing element will be smaller than in the previous examples. The resulting contact velocity is therefore larger than in the case of the previous embodiments; this is seen in FIG. 4 in that the lines 7 and 8*b* have a greater distance between them.

Figure 5:
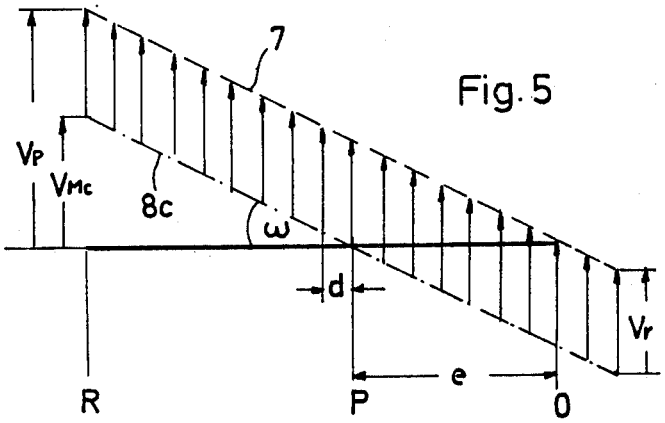

FIG. 5 shows the case of an embodiment in which the eccentricity of the mixing element is smaller than D/4, ie. the diameter of the mixing element is larger than the radius of the container. The angular velocity of the planet motion and the mixing element rotation are equal and opposite each other. The maximum speed of $V_{Mc}$ at the outer end of the mixing tool is therefore larger than in the first discussed embodiment and the resulting contact speed $V_r$ is smaller than in the previous examples.

FIGS. 3 through 5 show that by following the teachings of this invention one can achieve a constant mixing pattern throughout the container with any eccentricity e of the mixing element. In these Figures, however, one can see that different contact velocities are involved.

FIG. 5 is the least advantageous embodiment since only a single mixing element can be used; in the example of FIG. 3 two may be used. In FIG. 4 more than two mixing elements can be arranged in the container; the FIG. 4 embodiment permits the larger maximum through rate of mix material.

Figure 8:
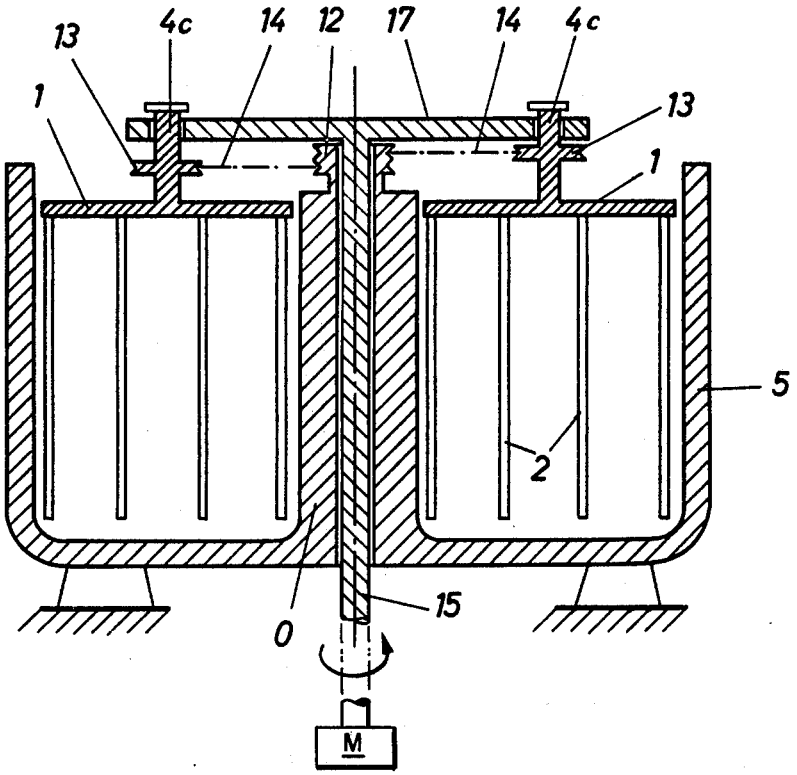
FIG. 8 is a longitudinal section of the FIG. 7 embodiment.

It has already been mentioned that the coupling of the container axis and the driving axis of the mixing element can be made quite simply. This is shown in FIGS. 6 and 7 and 8. FIG. 6 shows a coupling between axis O and driving axis 4 by means of a gear arrangement consisting of a fixed gear 9 and 10 connected respectively to the container axis and the driving axis 4 of the mixing element 1, both gears having the same diameter. The two gears engage gear 11, which is held by a carrier 17' and revolves with the carrier about the axis O.

FIGS. 7 and 8 show a connection between the container axis O and the driving axis 4 by means of pulleys 12 and 13, the pulleys are fixedly mounted on the axes, and have the equal diameters, and are connected by belt 14. A connection between the pulleys 12 and 13 is such as to cause a movement as that of the embodiment of FIG. 6 wherein, during the planet-like movement in the direction A, the mixing element turns in the opposite direction B and has relative to the container axis O no rotational movement.

The longitudinal cross-section according to FIG. 8 shows the pulley drive and the positioning of the mixing tool 1. A shaft 15 passes through axis O which supports pulley 12 having two tracks; cross-piece 17 is attached to the upper end of the shaft 15 and two bearings, carried by cross-piece 17, hold shafts 4*c* of the mixing element 1. Pulleys 13 are located on the shafts 4*c*.

When the shaft 15 is turned, as by a drive unit M (a conventional motor or the like), the mixing element will be rotated about the axis O. The pulley belt 14 and the pulleys 12 and 13 operate so that the shafts 4c turn in the bearings of cross-piece 17. The diameter of the pulleys 12 and 13 is such that it would appear to the observer that the mixing elements 1 do not turn about their own axes but, rather, merely revolve about the container axis O. The pulleys 12 and 13 and belt 14 may be toothed as shown respectively as pulleys 12' and 13' and belt 14' in FIG. 10. It is also possible to provide for other types of couplings, e.g. by controlling the various movememnts by means of synchronized separate driving means. The embodiments of FIGS. 6 and 7 are particularly simple in construction and are therefore particularly advantageous.

The above described concepts can be utilized in other embodiments as e.g. shown in FIG. 9. FIG. 9 shows a mixing element (multiple elements can be used, of course) having an axis inclined with respect to the axis of the container at approximately a 45 degree angle. The mixing element comprises plate 3 which has parallel rods extending from either side of the plate. The length of the individual rods is so that the end of the rods extend to the container floor and side walls without, however, touching them.

The driving connections can be carried out as in the previously described embodiments taking into account, however, the relationship $\omega_M = \omega_P \cos \alpha$; this can be achieved through e.g. different dimensions for the pulleys or gears. The coupling shown in FIG. 9 corresponds to that of FIG. 6. The same reference numbers have been used for corresponding elements.

The drive is carried out via a shaft 15 which extends through the gear 9'; the shaft 4d is rotatably mounted in the head 16. In order to provide for the oppositely directed rotational movement gear 11' is positioned between gears 9' and 10'.

What is claimed is:

1. A mixer comprising: a fixed mix container, the interior of which is essentially symmetrical about a vertical axis; at least one rotatably symmetrical mixing element having a plurality of mixing rods which are parallel to the axis of the mixing element, said mixing element axis being parallel to and laterally offset from the axis of the mixing container; carrier means; means rotatably mounting said mixing element on said carrier for rotation about said mixing element axis and means rotatably mounting said carrier means for rotation about the container axis; means for rotating said carrier means about the container axis to move the mixing element in a planet-like movement about the axis of the mixing container; and means, including said carrier means, for rotating the mixing element about its said axis as the carrier means rotates; the direction of rotation of the mixing element about the container axis being opposite to the direction of rotation of the element about its own axis, the angular velocities of the element corresponding to the relation $\omega_P = \omega_M$ where $\omega_P$ is the angular velocity of the element about the container axis and $\omega_M$ is the angular velocity of the element about the axis of the mixing element.

2. The mixer according to claim 1, in which the lateral offset e of the mixing element axis relative to the mixing container axis corresponds to one half of the inner diameter of the mixing container.

3. A mixer according to claim 2, in which at least two mixing elements are arranged diametrically opposite each other in the mixing container.

4. A mixer according to claim 1, wherein said means for rotating the mixing element about its own axis includes a gearing arrangement connected between said mixing container and said mixing element.

5. A mixer according to claim 4, wherein said means for moving said mixing element about the container axis includes a driven arm rotatable about the container axis and rotatable carrying said mixing element and said gearing arrangement includes first, second and third toothed gears, said first gear being rigidly mounted on and coaxial with, the axis of the mixing container, said second gear freely rotatably carried on said arm and engaged by said first gear, said third gear having the same diameter as the first gear and engaging said second gear and being rigidly mounted on and coaxial with the mixing element axis.

6. A mixer according to claim 4, wherein said gearing arrangement includes pulleys which have identical diameters and are respectively affixed to and coaxial with the axis of the mixing container and to and coaxial with the axis of the mixing element and a driving belt connects the two pulleys.

7. A mixer according to claim 6 in which the driving belt and pulleys are provided with teeth.

* * * * *